US009119430B1

(12) United States Patent
Fisher

(10) Patent No.: US 9,119,430 B1
(45) Date of Patent: Sep. 1, 2015

(54) ASSEMBLY FOR NECK AND ARM CLOTHING

(71) Applicant: Michael A. Fisher, Wichita, KS (US)

(72) Inventor: Michael A. Fisher, Wichita, KS (US)

( * ) Notice: Subject to any disclaimer, the term of this patent is extended or adjusted under 35 U.S.C. 154(b) by 0 days.

(21) Appl. No.: 14/101,986

(22) Filed: Dec. 10, 2013

(51) Int. Cl.
*A41F 1/00* (2006.01)
*A41B 1/14* (2006.01)

(52) U.S. Cl.
CPC .... *A41F 1/00* (2013.01); *A41B 1/14* (2013.01)

(58) Field of Classification Search
CPC ..... A41F 1/00; A41B 14/00
USPC ..... 2/132, 255, 256–264, 260.1, 134; D8/16, 18, 19, 20
See application file for complete search history.

(56) References Cited

U.S. PATENT DOCUMENTS

| | | | | | |
|---|---|---|---|---|---|
| 178,778 | A | * | 6/1876 | Hurlbut | 24/40 |
| 25,602 | A | | 6/1896 | Sommer | |
| 27,252 | A | | 6/1897 | Haskett | |
| 28,918 | A | | 6/1898 | Mulherin | |
| 47,096 | A | | 3/1915 | Baumann | |
| 48,015 | A | | 10/1915 | Sommer | |
| 1,463,400 | A | * | 7/1923 | Neumann | 24/40 |
| 2,004,288 | A | * | 6/1935 | Krick | 2/132 |
| 2,494,185 | A | | 1/1950 | Magney | |
| 2,651,782 | A | | 9/1953 | Oulouhojian | |
| 2,697,834 | A | | 12/1954 | Robinson | |
| 2,992,434 | A | | 7/1961 | Weeks | |
| 3,075,202 | A | | 1/1963 | Rubio | |
| 270,807 | A | | 10/1983 | Dilliner | |
| D270,807 | S | * | 10/1983 | Dilliner | D8/18 |
| 5,276,948 | A | | 1/1994 | Steadman | |
| 6,354,174 | B1 | | 3/2002 | Korwin | |
| 6,704,973 | B1 | | 3/2004 | Naham | |
| D528,880 | S | * | 9/2006 | Belflower | D8/16 |
| 8,220,075 | B2 | * | 7/2012 | Chen et al. | 2/132 |
| 8,533,866 | B1 | | 9/2013 | Lindquist | |
| 2008/0222852 | A1 | | 9/2008 | Stephan | |
| 2009/0038049 | A1 | * | 2/2009 | West | 2/132 |
| 2011/0219515 | A1 | * | 9/2011 | Chen et al. | 2/132 |
| 2013/0247270 | A1 | * | 9/2013 | Ross | 2/132 |
| 2014/0090152 | A1 | * | 4/2014 | Fernandez | 2/256 |

FOREIGN PATENT DOCUMENTS

| | | |
|---|---|---|
| JP | 11239531 | 2/1998 |

* cited by examiner

*Primary Examiner* — Gloria Hale
(74) *Attorney, Agent, or Firm* — Kenneth H. Jack; Davis & Jack, L.L.C.

(57) ABSTRACT

An assembly for neck and arm clothing, the assembly incorporating a flexible sheet having a foot end, a head end, and a longitudinal dimension extending from the foot end to the head end, the flexible sheet being oblongated in the direction of its longitudinal dimension; the assembly further incorporating a button hook, the button hook being formed wholly with the flexible sheet's head end; the assembly further incorporating pairs of chamfered edges positioned at opposite ends of the flexible sheet; the assembly further incorporating a dress shirt having collar stay pockets fitted for receiving the flexible sheet, wherein the dress shirt has button fastened sleeve plackets whose buttons may be engaged by the button hook and may be thereby drawn through the placket's buttonhole.

5 Claims, 7 Drawing Sheets

ASSEMBLY FOR NECK AND ARM CLOTHING

FIELD OF THE INVENTION

This invention relates to dress shirts. More particularly, this invention relates to special adaptations of dress shirts for facilitating and ergonomically assisting in their clothing of wearers' necks and lower arms.

BACKGROUND OF THE INVENTION

Formal dress shirts commonly comprise a collar which includes left and right collar points. Such dress shirts commonly further comprise button fastened sleeve plackets which open at the shirt's left and right cuffs. Such shirt's collar points commonly undesirably curl or otherwise deform, and such shirt's sleeve placket buttons are often fastened, necessarily in a one handed fashion, only with great difficulty. As a result of such collar point deformations and difficulties in sleeve placket buttoning, common dress shirts often defectively and ineffectively clothe a wearer's neck and lower arms or wrists.

The instant inventive assembly solves or ameliorates the above described deficits and difficulties arising upon a common dress shirt's clothing of a wearer's neck and lower arms by operatively associating with the shirt a flexible sheet member which is specially adapted for alternatively functioning as a collar stiffening stay and as a button hook.

BRIEF SUMMARY OF THE INVENTION

A first structural component of the instant inventive assembly for neck and arm clothing comprises a flexible sheet having a foot end and having a longitudinally oppositely positioned head end. In a preferred embodiment, the flexible sheet's longitudinal dimension extends from its foot end to its head end, and the flexible sheet is preferably oblongated or lengthened with respect to its lateral dimension along or in the direction of the longitudinal dimension.

In the preferred embodiment, the flexible sheet component has a substantially rectangular lateral cross-sectional shape, and such rectangular cross-section is preferably laterally oblongated. The flexible sheet's lateral and longitudinal oblongations preferably fit and size the flexible sheet for insertions into and extractions from dress shirt collar stay pockets, and alternatively for extensions into and through dress shirt buttonholes. In a preferred embodiment, the instant inventive assembly's flexible sheet component is composed of a material selected from the group consisting of plastic, aluminum, steel, silver, brass, and wood.

A further structural component of the instant inventive assembly comprises a button hook which is formed wholly with and forms an integral part of the flexible sheet's head end, the distal or tail end of such hook preferably being rounded for prevention of snagging against button stitches. In a preferred embodiment, the opening or throat portion of the button hook is fitted and sized for both receiving button stitches and hooking against such stitches' button.

Further structural components of the instant inventive assembly comprise a pair of chamfer pairs which constitute curved corners or relieved edges positioned at the lateral and oppositely lateral aspects of the flexible sheet's head and foot ends. Such chamfer pairs allow the flexible sheet to be easily extended into, out of, or through narrow openings such as stay pocket openings and buttonholes without snagging against opening edges.

In use of the instant inventive assembly, the flexible sheet component may be normally stored within a dress shirt collar's stay pocket. During such storage, the flexible sheet advantageously performs a function of stiffening of the collar's point and preventing unsightly deformations, distortions, or wrinkling of the collar. In the event that a wearer of the shirt encounters difficulty buttoning one of the shirt's sleeve placket buttons (such difficulties often arising because sleeve placket buttons typically must be buttoned in a one-handed fashion), the wearer may initially grasp and extract the flexible sheet from its normally stored position within the collar's stay pocket.

Thereafter, the wearer may extend either the chamfered head end or the chamfered foot end of the flexible sheet through the placket's buttonhole, such extension causing the sheet's foot end to protrude outwardly from the buttonhole and causing the head end to extend inwardly from the buttonhole. Thereafter, the wearer may cause the button hook at the head end of the flexible sheet to engage or capture the button via the button's stitching. Thereafter, the wearer may draw such stitching, along with attached button and placket edge toward the buttonhole until the button is pulled into and through the buttonhole. Optionally, the wearer may thereafter direct repetitions of such steps toward any of the shirt's other buttons. In circumstances where the wearer of the shirt has available only one manually dexterous hand, the wearer may advantageously continue to utilize the invention's button hooking flexible sheet upon all of the shirt's buttons. Thus, the instant inventive assembly assists handicapped persons with general buttoning tasks in addition to assisting able bodied persons in sleeve placket buttoning.

Following completion of the buttoning fastening steps described above, the wearer may return the flexible sheet to its normally stored position within the collar's stay pocket for recommencement of the invention's performance of the collar point stiffening function.

Accordingly, objects of the instant invention include the provision of an assembly for neck and arm clothing which incorporates structures, as described above, and which arranges such structures in manners described above, for the performance of the multiple functions and usage steps described above.

Other and further objects, benefits, and advantages of the instant invention will become known to those skilled in the art upon review of the Detailed Description which follows, and upon review of the appended drawings.

DETAILED DESCRIPTION OF A PREFERRED EMBODIMENT

Figure 5:
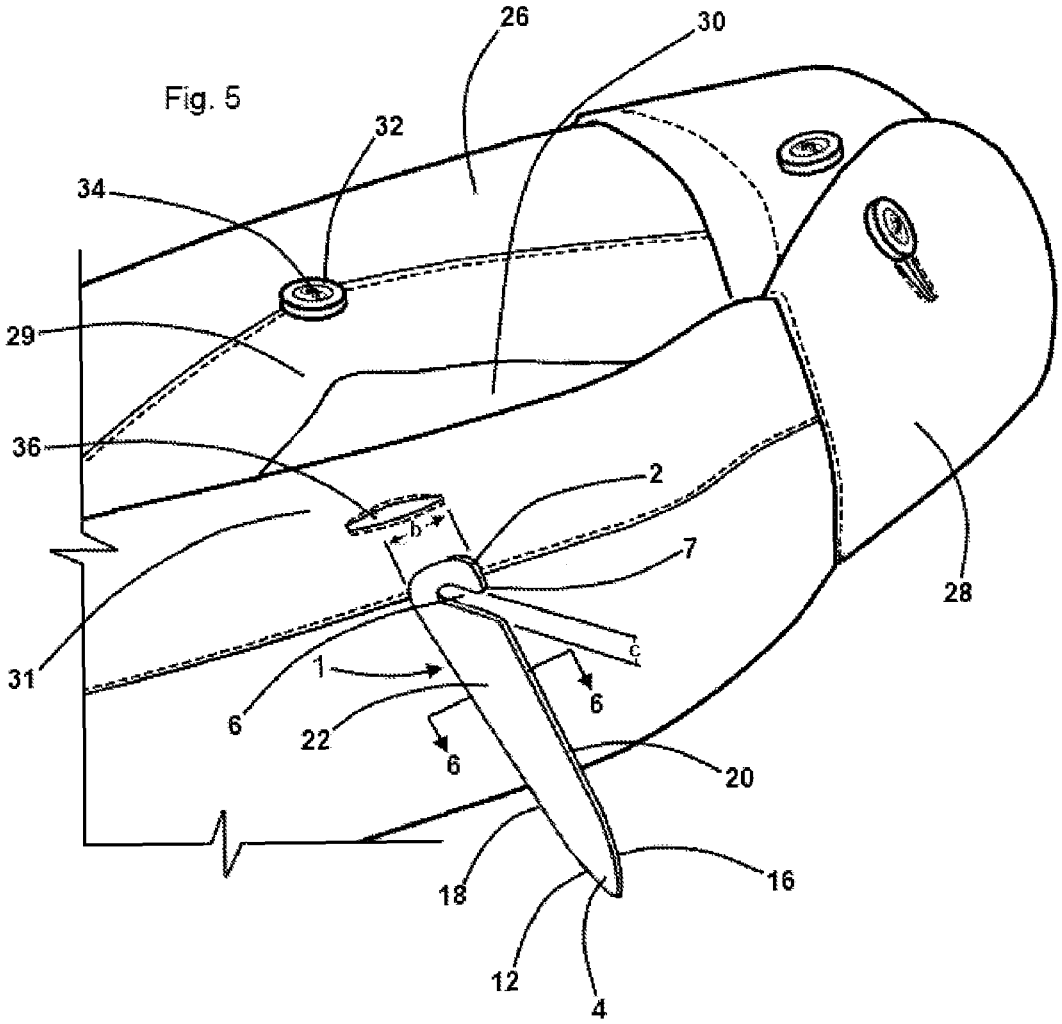
FIG. 5 redepicts the structure of FIG. 4, the view of FIG. 5 further showing the flexible sheet component.
Figure 6:
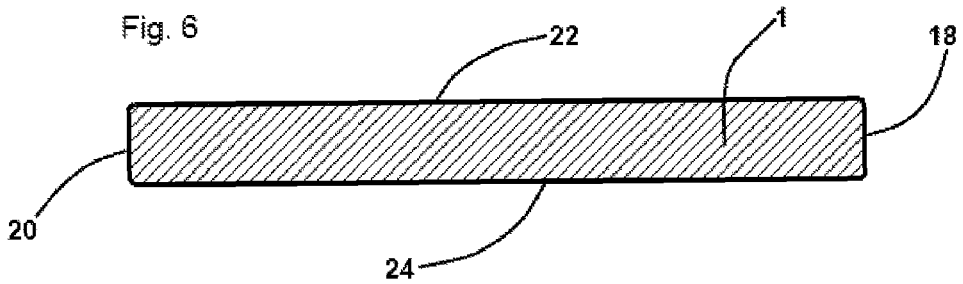
FIG. 6 is a sectional view as indicated in FIG. 5.

Referring now to the drawings, and in particular simultaneously to FIGS. 5 and 6, a flexible sheet component of the instant inventive assembly is referred to generally by Reference Arrow 1. In the preferred embodiment, the flexible sheet component 1 is composed of a material selected from the group consisting of plastic, aluminum, steel, silver, brass, bone, and wood. The flexible sheet 1 has a head end 2, a foot end 4, and has a longitudinal dimension extending from the head end 2 to the tail end 4. As indicated in FIG. 5, the flexible sheet 1 is oblongated along or in the direction of such longitudinal dimension. As indicated in the substantially rectangular cross section of FIG. 6, the lateral dimension of the flexible sheet 1 is similarly oblongated so that its right and left edges 20 and 18 have dimensions substantially shorter than the lateral spans of the sheet's top and bottom faces 22 and 24.

Figure 1:
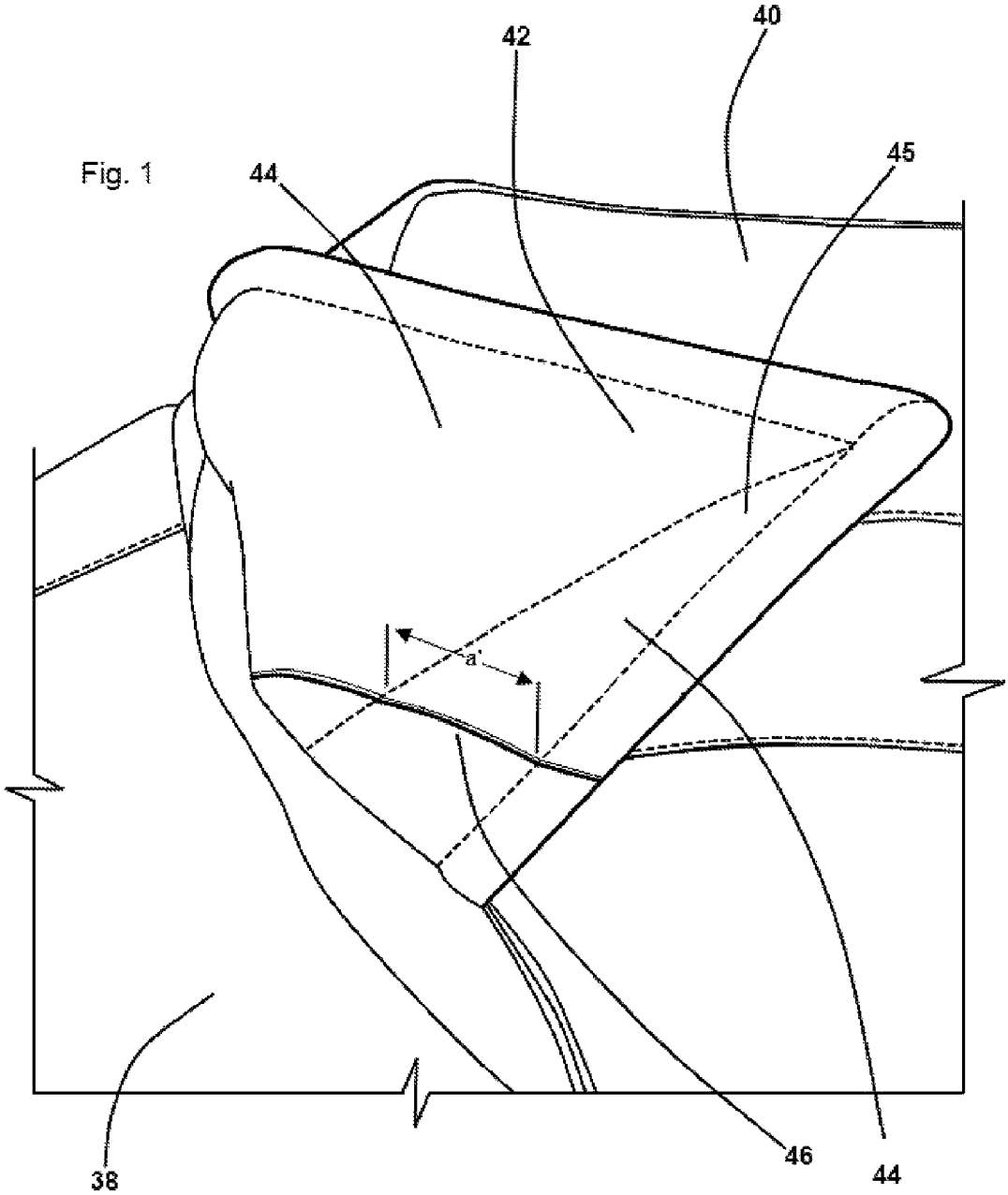
FIG. 1 is a view of shirt collar components of the instant inventive assembly.
Figure 2:
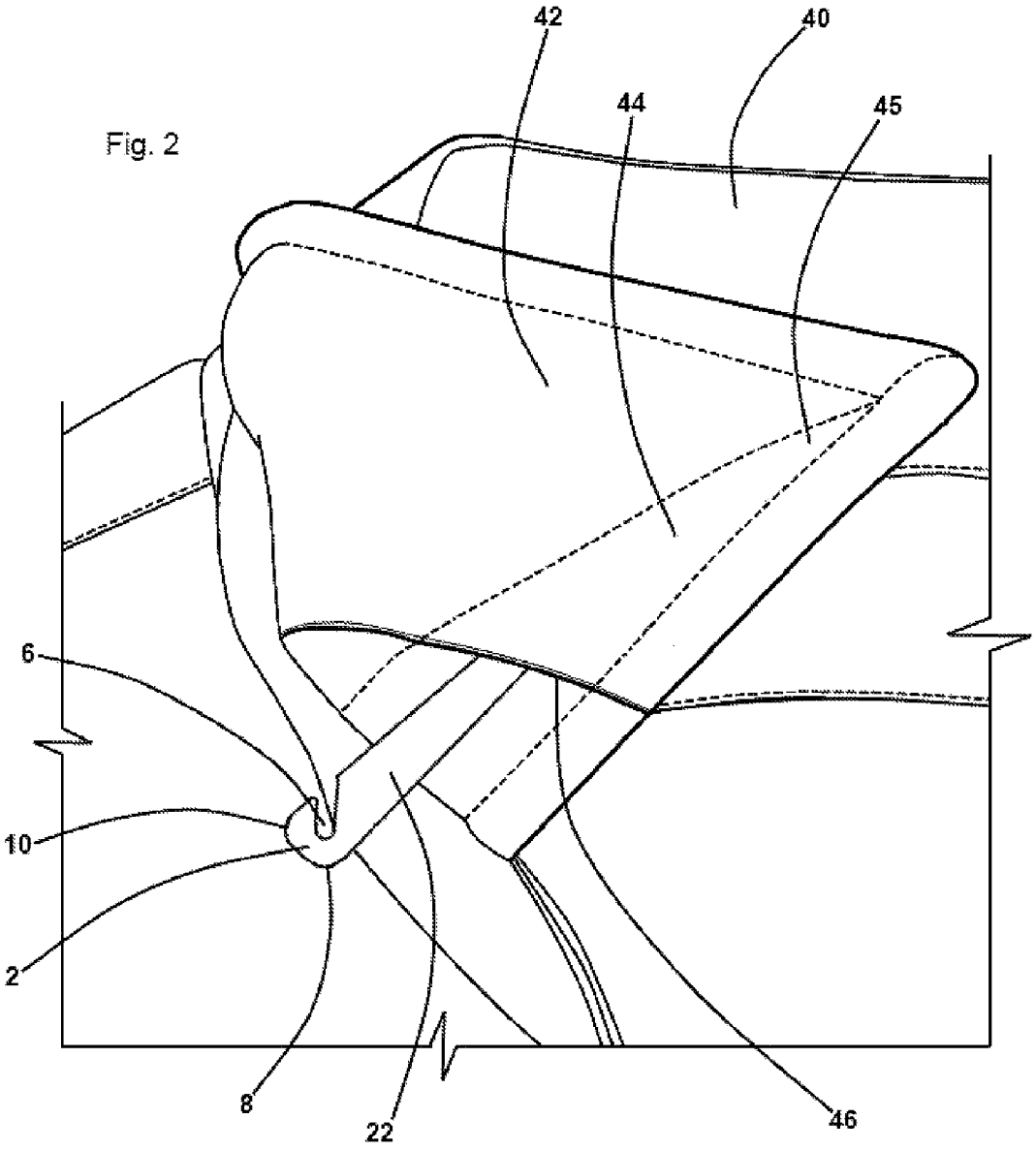
FIG. 2 redepicts the structure of FIG. 1, the view of FIG. 2 additionally showing a flexible sheet component of the instant inventive assembly.

Referring simultaneously to FIGS. 2 and 5, pairs of relieved or chamfered corners 8,10 and 12,16 are preferably respectively wholly formed with the head 2 and foot 4 ends of the flexible sheet 1, such chamfer pairs allowing either end of the flexible sheet 1 to be extended into and through narrow openings without snagging against opening edges.

Figure 3:
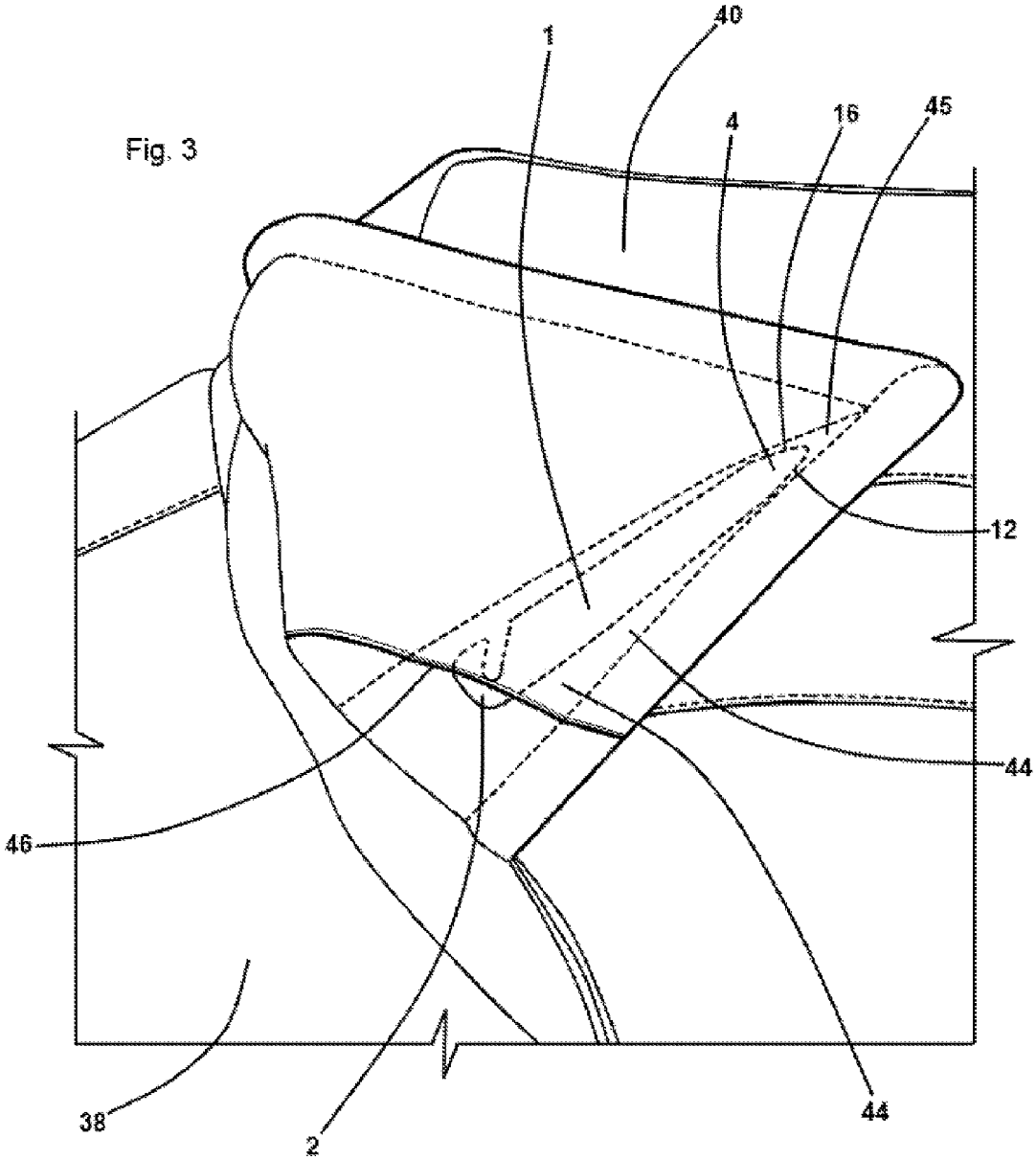
FIG. 3 redepicts the view of FIG. 2, the view of FIG. 3 showing the flexible sheet component alternatively positioned.

Referring simultaneously to FIGS. 1-5, the flexible sheet component 1 is preferably utilized in conjunction with a dress shirt 38 having a collar 40 with pointed collar tips 42 wherein such tips are specially configured to include hidden stay pockets 44 which are accessed via pocket openings 46. The flexible sheet 1 may initially be positioned as indicated in FIG. 2 so that its chamfered foot end 4 enters pocket opening 46. Thereafter, the flexible sheet 1 may be further slidably moved into and through opening 46 to become substantially totally received within the interior of pocket 44 as indicated in FIG. 3. Upon such receipt, the flexible sheet's chamfered edges 12 and 16 at its foot end 4 correspond with the "V" angle or vertex 45 of the pocket interior 44, such correspondence allowing the full length of the flexible sheet 1 to effectively function as a collar point stiffening member or stay.

Figure 4:
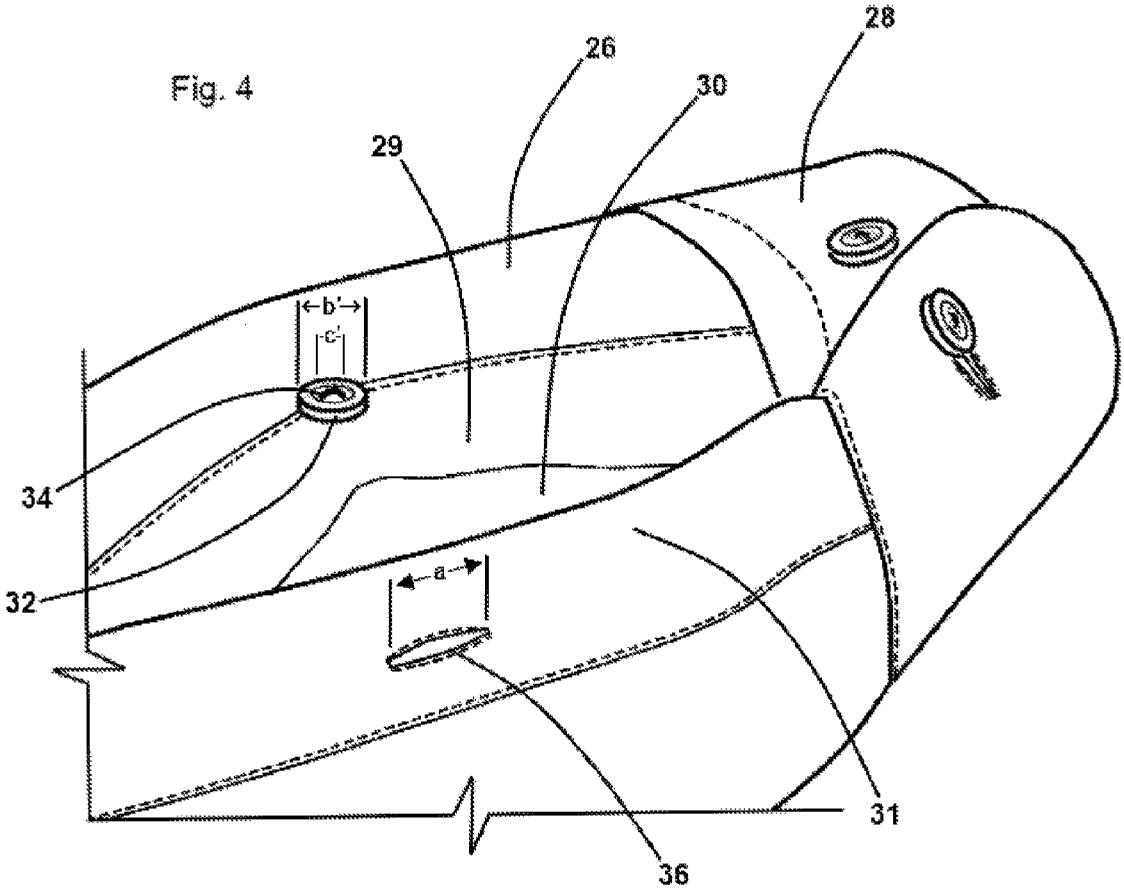
FIG. 4 shows a shirt placket component of the instant inventive assembly.

Referring simultaneously to FIGS. 3 and 4, the assembly's dress shirt 38 preferably includes shirt sleeves 26 whose cuffs 28 are opened by a placket 30 having hemmed edges 29 and 31. Such plackets 30 are alternatively openable during dressing and undressing and closeable by a button 32 and buttonhole 36 combination for clothing of the wearer's lower arm and wrist. Such sleeve placket buttons 32 are commonly difficult to secure within their buttonholes 36 because a wearer of such shirt typically must actuate the fastener through the use of the fingers of only one hand. The instant inventive assembly offers an easily useable and convenient alternative to attempting such one handed sleeve placket fastening by allowing the wearer to extract flexible sheet 1 from stay pocket 44 for use in the manner of a button hook.

Referring to FIGS. 2-5, the wearer may position the flexible sheet 1 with respect to sleeve placket buttonhole 36 as indicated in FIG. 5. Thereafter, the flexible sheet 1 may be extended through the buttonhole 36 by either inwardly extending the head end 2 (wherein chamfers 8 and 10 assist in such insertion) or foot end 4 may be outwardly extended therethrough (wherein chamfers 12 and 16 alternatively provide insertion assistance.

Referring to FIGS. 1-5, the laterally opposed edges of the head end 2 of the flexible sheet 1 are spaced away from each other a distance no greater than the lateral width of the central body of the flexible sheet 1, such lateral dimensioning of the head end 2, allowing the head end 2 to pass into and through buttonhole 36 without any undue impingement against or snagging upon the edges of the buttonhole 36. In the preferred embodiment, the lateral width b' of the flexible sheet 1 is less than or equal to the lateral width a of the buttonhole 36 and is less than the lateral width a' of the pocket opening 46, such dimensioning allowing the flexible sheet 1 to freely enter the buttonhole 36 (similarly with button 32) and alternatively freely enter pocket 44.

Figure 7:
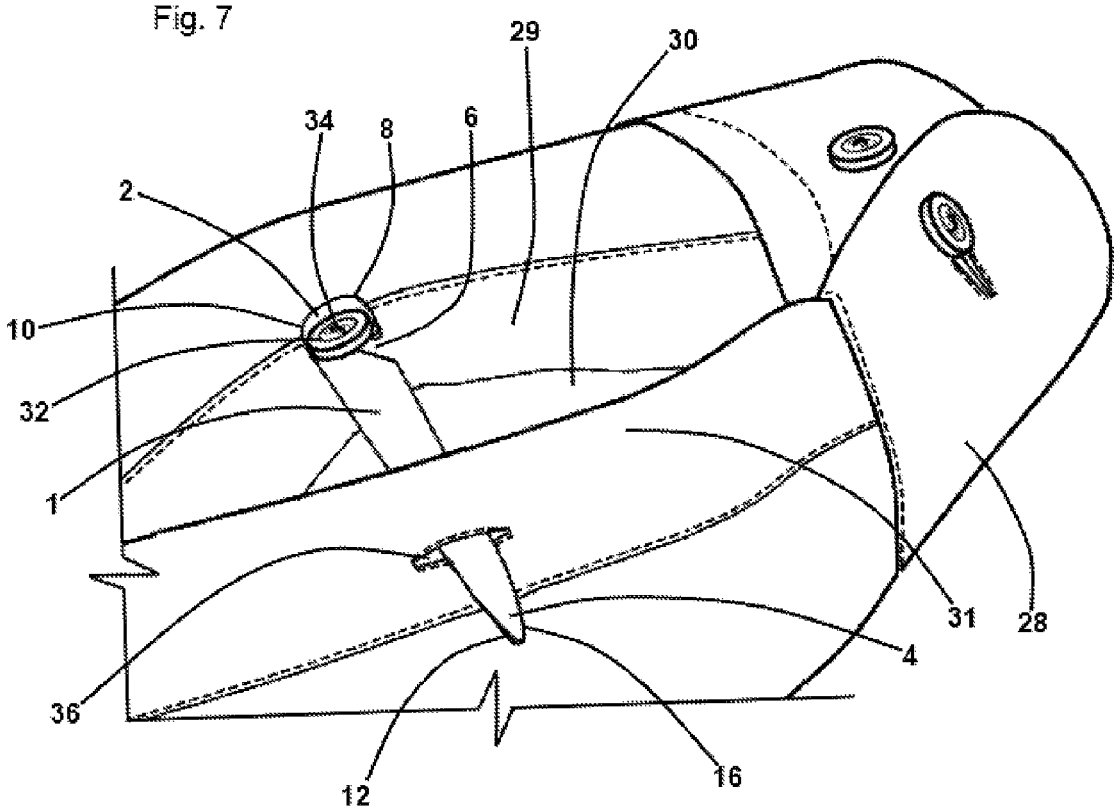
FIG. 7 redepicts the structure of FIG. 5, the view of FIG. 7 showing the flexible sheet component alternatively positioned.

Referring simultaneously to FIGS. 4, 5, and 7, following insertion of the flexible sheet 1 through buttonhole 36, the throat or opening 6 of the button hook formed at the head end 2 may be extended beneath button 32 and about such button's stitching 34. Such engagement advantageously allows the button hook to securely grasp the button 32, the stitching 34, and the hemmed edge 29 of placket 30. In the preferred embodiment, the distal or tail end 7 of such button hook is curved or rounded for prevention of snagging against stitching 34. Also, the width c of the opening of the throat 6 is preferably greater than or equal to the width c' of the stitching 34, while such width c is preferably less than the diameter b' of button 32 in order to allow the button 32 to correspondingly function as a hooking member against the top face 22 of the flexible sheet 1.

Figure 8:
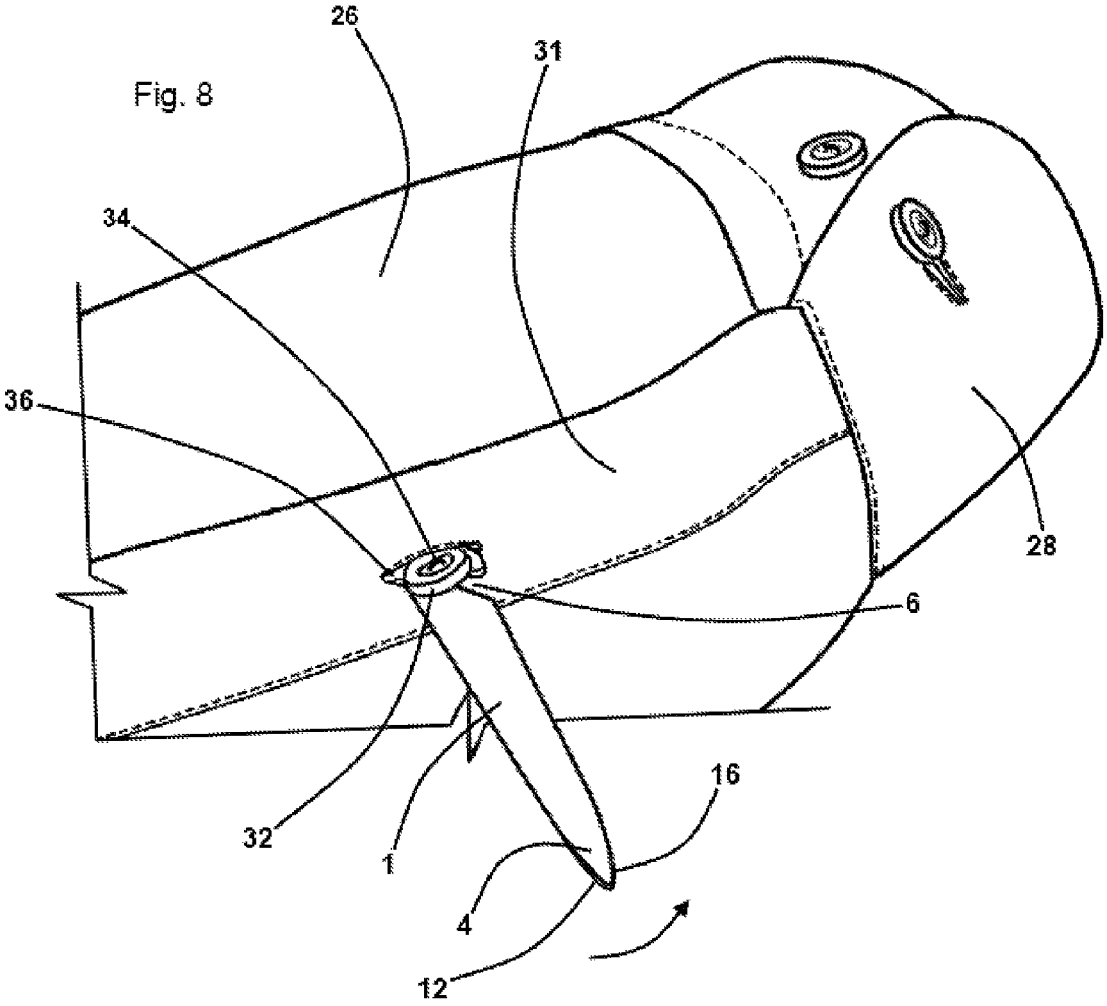
FIG. 8 redepicts the structure of FIG. 7, the view of FIG. 8 showing the flexible sheet component and the shirt placket component further alternatively configured.

Thereafter, as indicated in FIG. 8, the wearer may pull against the foot end 4 of the flexible sheet 1 causing the hook configured head end 2 to draw the button 32 into and through the buttonhole 36. Thereafter, counter clockwise rotation of the flexible sheet 1 about stitching 34 and in the direction of the arrow drawn upon FIG. 8, may cause the complete undersurface of button 32 to overlie and transfer its hooking function to the outer aspects of buttonhole 36, such rotation completing the sleeve placket buttoning process.

Such transfer of the button's hooking function with respect to head 2 to the hooking function at and about buttonhole 36 advantageously disengages the flexible sheet 1 from the button 32 and its stitching 34, and allows the flexible sheet 1 to be returned to its collar point stiffening position as indicated in FIG. 3. In a preferred embodiment, a pair of similarly configured flexible sheets 1 are provided, one for the stay pocket of each of the shirt's collar points.

Accordingly, the instant inventive assembly allows the dress shirt 38 to substantially continuously function for collar point stiffening while being continuously ready to assist in the manner described above with fastening of sleeve placket buttons.

While the principles of the invention have been made clear in the above illustrative embodiment, those skilled in the art may make modifications in the structure, arrangement, portions, components, and usage steps of the invention without departing from those principles. Accordingly, it is intended that the description and drawings be interpreted as illustrative and not in the limiting sense, and that the invention be given a scope commensurate with the appended claims.

The invention hereby claimed is:

1. An assembly for clothing a shirt wearer's neck and arms, said assembly comprising a neck collar stay and button hook combination, said assembly further comprising:

(a) a flexible sheet, the flexible sheet comprising the neck collar stay and button hook combination, the flexible sheet having a foot end, a head end, and a longitudinal dimension extending from the foot end to the head end, the flexible sheet being longitudinally oblongated;

(b) a button hook, the button hook being formed wholly with the flexible sheet's head end, the button hook having a tail end extending toward the flexible sheet's foot end; and (c) a pair of chamfer pairs, a first chamfer pair among the pair of chamfer pairs being formed wholly with the flexible sheet's head end, and the other chamfer pair being formed wholly with the flexible sheet's foot end, wherein the flexible sheet has a rectangular lateral cross-section, said cross-section being laterally oblongated, wherein the flexible sheet is adapted for performing collar staying, and wherein the button hook is adapted for performing button hooking.

2. The assembly of claim 1 wherein the flexible sheet is composed of a material selected from the group consisting of plastic, aluminum, steel, silver, brass, and wood.

3. An assembly for clothing a shirt wearer's neck and arms, said assembly comprising a neck collar stay and button hook combination, said assembly further comprising:

(a) a flexible sheet, the flexible sheet comprising the neck collar stay and button hook combination, the flexible sheet having a foot end, a head end, and a longitudinal dimension extending from the foot end to the head end, the flexible sheet being longitudinally oblongated;

(b) a button hook having a tail extending toward the flexible sheet's foot end, the button hook being formed wholly with the flexible sheet's head end, the button hook having a tail end extending tailwardly from the flexible sheet's head end; and (c) a pair of chamfer pairs, a first chamfer pair among the pair of chamfer pairs being formed wholly with the flexible sheet's head end, and the other chamfer pair being formed wholly with the flexible sheet's foot end, wherein the flexible sheet is composed of a material selected from the group consisting of plastic, aluminum, steel, silver, brass, and wood, and has a substantially rectangular lateral cross-section, said cross-section being laterally oblongated, and further comprising a dress shirt, the dress shirt having a collar comprising a pair of stay pockets, each stay pocket being fitted for slidably receiving the flexible sheet, the flexible sheet being received within one of the stay pockets, wherein the flexible sheet is adapted for performing collar staying, and wherein the button hook is adapted for performing button hooking.

4. The assembly of claim 3 wherein the dress shirt comprises a pair of sleeve plackets and further comprising a pair of button and buttonhole combinations connected operatively to the sleeve plackets, said combinations' buttonholes being fitted for receiving the flexible sheet.

5. The assembly of claim 4 wherein the button and buttonhole combinations further comprise button stitches, the button hook being fitted for receiving the button stitches.

* * * * *